US008596345B2

(12) United States Patent
Li et al.

(10) Patent No.: US 8,596,345 B2
(45) Date of Patent: Dec. 3, 2013

(54) RCD SEALING ELEMENTS WITH MULTIPLE ELASTOMER MATERIALS

(75) Inventors: Yanmei Li, Katy, TX (US); Alan W. Lockstedt, Magnolia, TX (US); Sudarsanam Chellappa, Houston, TX (US)

(73) Assignee: Smith International, Inc., Houston, TX (US)

( * ) Notice: Subject to any disclaimer, the term of this patent is extended or adjusted under 35 U.S.C. 154(b) by 377 days.

(21) Appl. No.: 13/070,752

(22) Filed: Mar. 24, 2011

(65) Prior Publication Data

US 2012/0118559 A1 May 17, 2012

Related U.S. Application Data

(60) Provisional application No. 61/414,138, filed on Nov. 16, 2010.

(51) Int. Cl.
*E21B 33/068* (2006.01)

(52) U.S. Cl.
USPC ..... 166/84.3; 251/1.1

(58) Field of Classification Search
USPC ..... 166/84.3, 81.1; 251/1.1, 1.2
See application file for complete search history.

(56) References Cited

U.S. PATENT DOCUMENTS

| | | | | |
|---|---|---|---|---|
| 4,367,795 | A | 1/1983 | Biffle | |
| 4,480,703 | A * | 11/1984 | Garrett | 175/195 |
| 4,531,580 | A | 7/1985 | Jones | |
| 5,022,472 | A | 6/1991 | Bailey et al. | |
| 5,901,964 | A | 5/1999 | Williams et al. | |
| 6,354,385 | B1 | 3/2002 | Ford et al. | |
| 8,353,497 | B2 * | 1/2013 | Trevas | 251/1.3 |
| 2009/0255734 | A1 | 10/2009 | Williams | |
| 2012/0261888 | A1 * | 10/2012 | Borden et al. | 277/562 |

OTHER PUBLICATIONS

Search Report and Written Opinion issued in related International Patent Application No. PCT/US2011/030418; Dated: Sep. 30, 2011 (9 pages).

International Report on Patentability and Written Opinion issued in corresponding International Application No. PCT/US2011/030418 dated May 30, 2013 (6 pages).

* cited by examiner

*Primary Examiner* — William P Neuder

(74) *Attorney, Agent, or Firm* — Osha Liang LLP

(57) ABSTRACT

A sealing element for a rotating control device is disclosed, wherein the sealing element has an inner surface which forms a drillstring bore extending axially through the sealing element, an attachment end having a receiving cavity extending into the attachment end substantially parallel with the drillstring bore, a nose end opposite from the attachment end, wherein the nose end has an inner diameter smaller than the inner diameter of the attachment end, a throat region between the attachment end and the nose end, at least one soft elastomer region comprising a soft elastomer material having a hardness of 70 duro or less, and at least one stiff elastomer region comprising a stiff elastomer material having a hardness greater than 70 duro.

36 Claims, 17 Drawing Sheets

RCD SEALING ELEMENTS WITH MULTIPLE ELASTOMER MATERIALS

CROSS-REFERENCE TO RELATED APPLICATIONS

Pursuant to 35 U.S.C. §119(e), this Application claims priority to U.S. Provisional Application 61/414,138, filed on Nov. 16, 2010, which is herein incorporated by reference in its entirety.

BACKGROUND OF INVENTION

1. Field of Invention

The present invention relates generally to rotating control device ("RCD") sealing elements. In particular, the present invention relates to RCD sealing elements having two or more elastomeric materials.

2. Background Art

An earth-boring drill bit is typically mounted on the lower end of a drill string and is rotated by rotating the drill string at the surface or by actuation of downhole motors or turbines, or by both methods. When weight is applied to the drill string, the rotating drill bit engages the earthen formation and proceeds to form a borehole along a predetermined path toward a target zone. Because of the energy and friction involved in drilling a wellbore in the earth's formation, drilling fluids, commonly referred to as drilling mud, are used to lubricate and cool the drill bit as it cuts the rock formations below. Furthermore, in addition to cooling and lubricating the drill bit, drilling mud also performs the secondary and tertiary functions of removing the drill cuttings from the bottom of the wellbore and applying a hydrostatic column of pressure to the drilled wellbore.

Typically, drilling mud is delivered to the drill bit from the surface under high pressures through a central bore of the drillstring. From there, nozzles on the drill bit direct the pressurized mud to the cutters on the drill bit where the pressurized mud cleans and cools the bit. As the fluid is delivered downhole through the central bore of the drillstring, the fluid returns to the surface in an annulus formed between the outside of the drillstring and the inner profile of the drilled wellbore. Because the ratio of the cross-sectional area of the drillstring bore to the annular area is relatively low, drilling mud returning to the surface through the annulus does so at lower pressures and velocities than it is delivered. Nonetheless, a hydrostatic column of drilling mud typically extends from the bottom of the hole up to a bell nipple of a diverter assembly on the drilling rig. Annular fluids exit the bell nipple where solids are removed, the mud is processed, and then prepared to be re-delivered to the subterranean wellbore through the drillstring.

As wellbores are drilled several thousand feet below the surface, the hydrostatic column of drilling mud serves to help prevent blowout of the wellbore as well. Often, hydrocarbons and other fluids trapped in subterranean formations exist under significant pressures. Absent any flow control schemes, fluids from such ruptured formations may blow out of the wellbore and spew hydrocarbons and other undesirable fluids (e.g., $H_2S$ gas).

Further, under certain circumstances, the drill bit will encounter pockets of pressurized formations and will cause the wellbore to "kick" or experience a rapid increase in pressure. Because formation kicks are unpredictable and would otherwise result in disaster, flow control devices known as blowout preventers ("BOPs"), are mandatory on most wells drilled today. One type of BOP is an annular blowout preventer. Annular BOPs are configured to seal the annular space between the drill string and the inside of the wellbore. Annular BOPs typically include a large flexible rubber packing unit of a substantially toroidal shape that is configured to seal around a variety of drill string sizes when activated by a piston. Furthermore, when no drill string is present, annular BOPs may even be capable of sealing an open bore. While annular BOPs are configured to allow a drill string to be removed (i.e., tripped out) or inserted (i.e., tripped in) therethrough while actuated, they are not configured to be actuated during drilling operations (i.e., while the drill string is rotating). Because of their configuration, rotating the drill string through an activated annular blowout preventer would rapidly wear out the packing element, thus causing the blowout preventer to be less capable of sealing the well in the event of a blowout.

Thus, rotating control devices ("RCD") are frequently used in oilfield drilling operations where elevated annular pressures are present to seal around drill string components and prevent fluids in the wellbore from escaping. For example, conventional RCDs may be capable of isolating pressures in excess of 1,000 psi while rotating (i.e., dynamic) and 2,000 psi when not rotating (i.e., static). A typical RCD includes a packing element and a bearing package, whereby the bearing package allows the packing element to rotate along with the drillstring. Therefore, in using a RCD, there is no relative rotational movement between the packing element and the drillstring, only the bearing package exhibits relative rotational movement. Examples of RCDs include U.S. Pat. No. 5,022,472 issued to Bailey et al. on Jun. 11, 1991 (assigned to Drilex Systems), and U.S. Pat. No. 6,354,385 issued to Ford et al. on Mar. 12, 2002, assigned to the assignee of the present application, and both are hereby incorporated by reference herein in their entirety. In some instances, dual stripper rotating control devices having two sealing elements, one of which is a primary seal and the other a backup seal, may be used.

A typical RCD is shown in FIG. 1, wherein an RCD 100 includes a sealing element 110 (also referred to as a "stripper element"), which acts as a passive seal that maintains a constant barrier between the atmosphere and wellbore. In particular, the RCD 100 is in fluid communication with the wellbore during drilling operations. The pressure within the wellbore may be exerted upon the sealing element 110 of the RCD 100 that seals against drill string 160. The sealing element 110 is bolted to a drive-bushing 120 with bolt 122, and a drive-ring 130 is connected to the drive-bushing 120 such that the drive-ring 130 turns with the drive-bushing 120. A lower-sleeve 140 is attached to the drive-ring 130 opposite from the drive-bushing 120. A bearing package 150 surrounds the drive-ring 130 and lower-sleeve 140, wherein roller-bearings 152 are disposed between the bearing package 150 and the drive-ring 130, and a dynamic seals stack 154 is disposed between the bearing package 150 and the lower-sleeve 140. Drill string 160 extends from a drilling rig (not shown) through the sealing element 110 and into the wellbore (not shown). In underwater drilling operations, the drill string may extend from the drilling rig, through a riser and to the wellbore through the subsea wellhead as if the riser sections are a mere extension of the wellbore itself.

Typically, a drill string includes a plurality of the drill pipes connected by threaded connections located on both ends of the plurality of drill pipes. Threaded connections may be flush with the remainder of the drill string outer diameter, but generally have an outer diameter larger than the remainder of the drill string. For example, as shown in FIG. 1, drill string 160 is formed of a long string of threaded pipes 162 joined together with tool joints 164, wherein the tool joints 164 have an outer diameter larger than the outer diameter of the pipes 162. As the drill string is translated through the wellbore and the RCD 100, the sealing element 110 may squeeze against an outer surface of the drill string 160, thereby sealing the wellbore. In particular, the inner diameter of a sealing element is smaller than the objects (e.g., drill pipe, tool joints) that pass through to ensure sealing with zero wellbore pressure. However, the outer geometry of the passive seal creates higher sealing pressure as wellbore pressure increases.

In many prior art RCDs, a Kelly drive is used to rotate the drill string, and thus drill bit. A typical Kelly drive includes a section of polygonal or splined pipe that passes through a mating polygonal or splined bushing and rotary table. The rotary table turns the Kelly bushing, which rotates the Kelly pipe section and the attached drill string. The Kelly pipe-bushing fit allows the pipe to simultaneously rotate and move in a vertical direction. Thus, in RCDs using a Kelly drive, the drill string is rotated using the rotary table in a wrench-like configuration. Because sealing elements used with Kelly drives do not rotate the drill string, sealing element failures in Kelly drives are commonly due to wellbore pressure rather than torsional loading. Conversely, when top drives are used, a sealing element may be used to turn the drill string assembly and to seal the wellbore pressure. Thus, sealing elements used with top drives are subject to failure from a combination of torsional loading and wellbore pressure.

A side and top view of an exemplary sealing element used with a top drive RCD is shown in FIGS. 2A and 2B, wherein a sealing element 200 has an attachment end 210 and a nose end 220. The attachment end is typically attached to a drive-bushing (not shown) using a metal attachment piece, such as a bolt. The nose end 220 has an inner diameter that is smaller than the inner diameter of the attachment end 210 to provide a tight seal against the drillstring. Further, as shown in FIGS. 2A-B, the outer diameter 212 of the attachment end may be larger than the outer diameter 222 of the nose end 220.

Typically, a sealing element is made up of a single elastic material, stripper rubber, which may mechanically deform to seal around various diameters of drill pipe. Conventional sealing element material may include natural rubber, nitrile, butyl or polyurethane, for example, and depends on the type of drilling operation. Additionally, a sealing element may be formed of a fiber reinforced material, such as that described in U.S. Pat. No. 5,901,964.

However, conventional sealing elements in top drive RCDs tend to split or experience chunking when encountering torsion loading or other harsh dynamic conditions due to poor tear resistance. Further, over time the sealing element may become worn and unable to substantially deform to provide a seal around the drill string. Consequently, the sealing element must be replaced, which may lead to down time during drilling operations that can be costly to a drilling operator.

Accordingly, there remains a need to improve the life of seals used for rotating control devices in drilling operations.

SUMMARY OF INVENTION

In one aspect, embodiments disclosed herein relate to sealing elements for a rotating control device that have an inner surface which forms a drillstring bore extending axially through the sealing element, an attachment end having a receiving cavity extending into the attachment end substantially parallel with the drillstring bore, a nose end opposite from the attachment end, wherein the nose end has an inner diameter smaller than the inner diameter of the attachment end, a throat region between the attachment end and the nose end, at least one soft elastomer region comprising a soft elastomer material having a hardness of 70 duro or less, and at least one stiff elastomer region comprising a stiff elastomer material having a hardness greater than 70 duro.

In another aspect, embodiments disclosed herein relate to a rotating control device that has a sealing element with a drillstring bore extending axially therethrough, wherein the sealing element has an inner surface which forms the drillstring bore, an attachment end having a receiving cavity extending into the attachment end substantially parallel with the drill string bore, a nose end opposite from the attachment end, wherein the nose end has an inner diameter smaller than the inner diameter of the attachment end, a throat region between the attachment end and the nose end, at least one soft elastomer region comprising a soft elastomer material having a hardness ranging from about 50 to 70 duro, and at least one stiff elastomer region comprising a stiff elastomer material having a hardness ranging from greater than 70 to about 90 duro. A metal attachment piece is disposed within the receiving cavity of the attachment end, and at least a portion of the attachment end is made of the stiff elastomer material.

Other aspects and advantages of the invention will be apparent from the following description and the appended claims.

DETAILED DESCRIPTION

During drilling operations, a sealing element is configured to maintain a seal with a drillstring as the drillstring is translated through the wellbore. Specifically, a sealing element has a drillstring bore extending axially therethrough, which is configured to engage and seal around a drillstring as it is translated through the wellbore. According to embodiments disclosed herein, a sealing element has an attachment end, a nose end opposite from the attachment end, and a throat region between the attachment end and the nose end. The attachment end of a sealing element has a receiving cavity extending into the attachment end substantially parallel with the drillstring bore. The receiving cavity is configured to receive a metal attachment piece, which is used to secure the sealing element to the drive-bushing of a RCD. Additionally, the sealing element may be configured to control the pressure of a fluid, thereby allowing the sealing element to seal around various shapes and sizes of components of the drill string. However, continuous high pressure and wear commonly leads to failure of the sealing element.

Figure 3A:
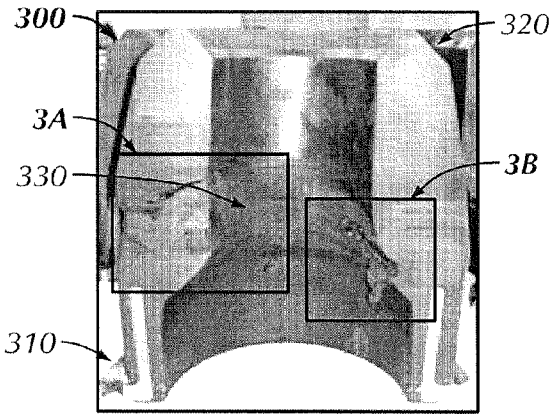
FIG. 3A PRIOR ART
FIGS. 3A-D show failed prior art sealing elements.
Figure 3B:
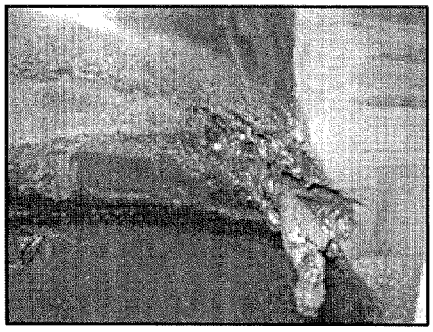
FIG. 3B PRIOR ART
Figure 3C:
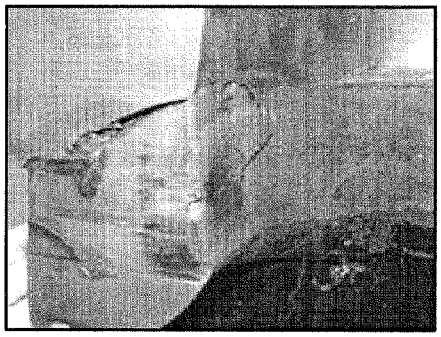
FIG. 3C PRIOR ART
Figure 3D:
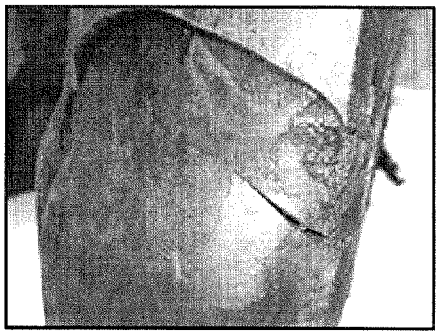
FIG. 3D PRIOR ART

FIGS. 3A-D show potential sealing element failure mechanisms. In particular, the sealing element shown is made of nitrile butadiene rubber ("NBR") having a hardness of 60 duro, which has been subjected to a stripping test conducted at 500 psi. However, the failures shown are common to sealing elements made of other materials having various hardness values, as well. FIG. 3A shows a sealing element 300 that has been cut in half along a longitudinal plane so that cross-sections of the sealing element wall can be seen. The sealing element 300 has an attachment end 310, a nose end 320, and a throat region 330 located between the attachment end 310 and the nose end 320. FIGS. 3B-D show magnified views of the failures. As shown in FIG. 3B, chunking has occurred on the inner surface of the throat region of the sealing element. FIG. 3C shows a crack extending through the wall of the sealing element in the throat region, wherein the crack extends from the inner surface of the throat region to the outer surface of the wall. FIG. 3D shows a magnified view of the crack on the outer surface of the wall, wherein the crack extends a distance along the outer surface of the wall.

The inventors of the present disclosure have found that failures such as the ones described above may result from a combination of three different directional stresses. In particular, RCD sealing elements may encounter (1) vertical shear stress caused by the axial movement of the drill string through the sealing element, (2) torsional stress caused by the drillstring rotating the sealing element, and (3) tension and compression stresses caused by tool joints. Tool joints may exert tension and compression stresses on a sealing element when the tool joints have larger diameters than the connected drill pipe by expanding the inner diameter of the sealing element as they pass through the sealing element. In addition to the three directional stresses described above, other conditions encountered in drilling applications such as wellbore pressure, misalignment, and hard-banding, for example, may aggravate the directional stress conditions and lead to increased rates of failure.

Figure 4:
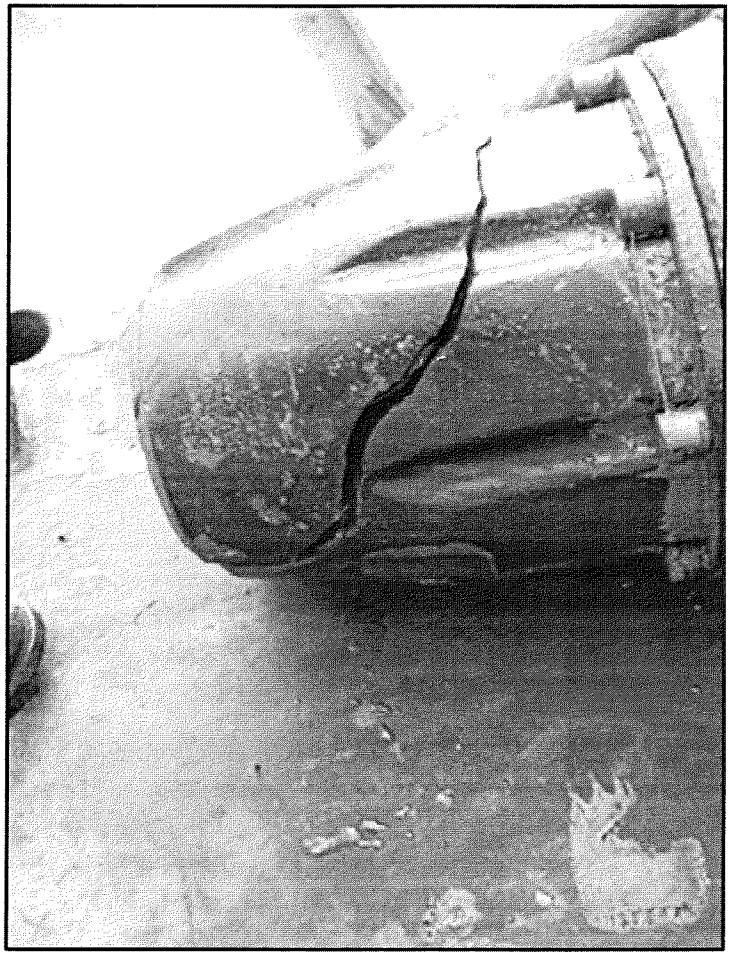
FIG. 4 PRIOR ART
FIG. 4 is a photograph of prior art sealing element failure.

It has been found that single-material sealing elements made with soft elastomer material may be used for improved sealing performance. However, prior art sealing elements made of soft elastomer material often fail from chunking. In particular, soft elastomer sealing elements subject to vertical shear stress (caused by the axial movement of the drill string through the sealing element) and tension and compression stresses (caused by tool joints) may undergo buckling (i.e., the sealing element folds up), which leads to chunking. In view of the above, a stiff elastomer material may be chosen to make single-material sealing elements due to its resistance to severe buckling. However, prior art sealing elements made with stiff elastomer material often fail from splitting, or tearing, which may be caused by torsional stress experienced as the drill string rotates the sealing element. Thus, although prior art sealing elements made of stiffer rubber may withstand higher stripping pressures, they tend to split when encountering torsional loading, or other harsh dynamic conditions, due to poor tear resistance. For example, FIG. 4 shows an example of a single-material sealing element made of a stiff elastomer that has failed by splitting.

Advantageously, the inventors of the present disclosure have found that by using two or more elastomer materials to make RCD sealing elements, the sealing elements have improved pressure ratings, wear resistance, tear resistance, stiffness and fatigue life. In particular, embodiments disclosed herein have a sealing element made of two or more different elastomer materials, including at least one soft elastomer material and at least one stiff elastomer material, wherein each elastomer material forms a separate region from the other elastomer material(s). As used herein, a soft elastomer material refers to an elastomer material having a hardness of 70 duro or less, and a stiff elastomer material is an elastomer material having a hardness greater than 70 duro. In exemplary embodiments, a soft elastomer material has a hardness ranging from about 50 to 70 duro, and a stiff elastomer material has a hardness ranging from greater than 70 to about 90 duro. Examples of soft and stiff elastomer materials include NBR, HNBR, natural rubber, butyl, urethane, as well as other elastomers known in the art.

Sealing elements of the present disclosure may be formed of at least one stiff elastomer material and at least one soft elastomer material, wherein the stiff elastomer material and the soft elastomer material are the same elastomer type (e.g., NBR-NBR or HNBR-HNBR), but have different hardness values, such as NBR with a hardness of 70 duro or less for the soft elastomer material and NBR with a hardness of greater than 70 duro for the stiff elastomer material. In other embodiments, sealing elements may be formed of at least one stiff elastomer material and at least one soft elastomer material, wherein the soft elastomer material and the stiff elastomer material are different elastomer types (e.g., NBR-HNBR or Butyl-HNBR).

The hardness of the elastomer materials may engineered to create either a soft elastomer material (having a hardness of 70 duro or less) or a stiff elastomer material (having a hardness of greater than 70 duro) by altering cross-linking density, compounding, adding fillers, or other methods known in the art. Further, in particular embodiments, each elastomer region is substantially continuous, meaning that each elastomer region forms a separate yet uninterrupted portion of the sealing element from the other elastomer region(s).

Figure 5A:
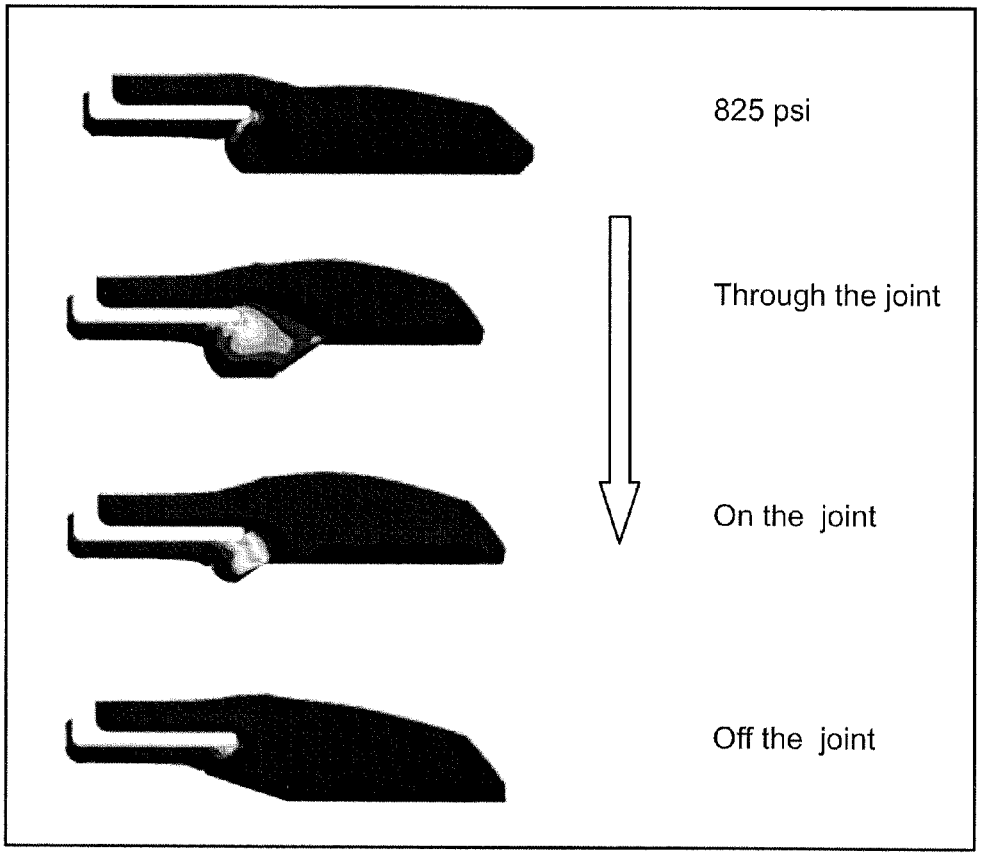
FIG. 5A PRIOR ART
FIGS. 5A-C are FEA plots of the amount of distortion experienced in two prior art sealing elements and a sealing element made according to embodiments of the present disclosure.
Figure 5B:
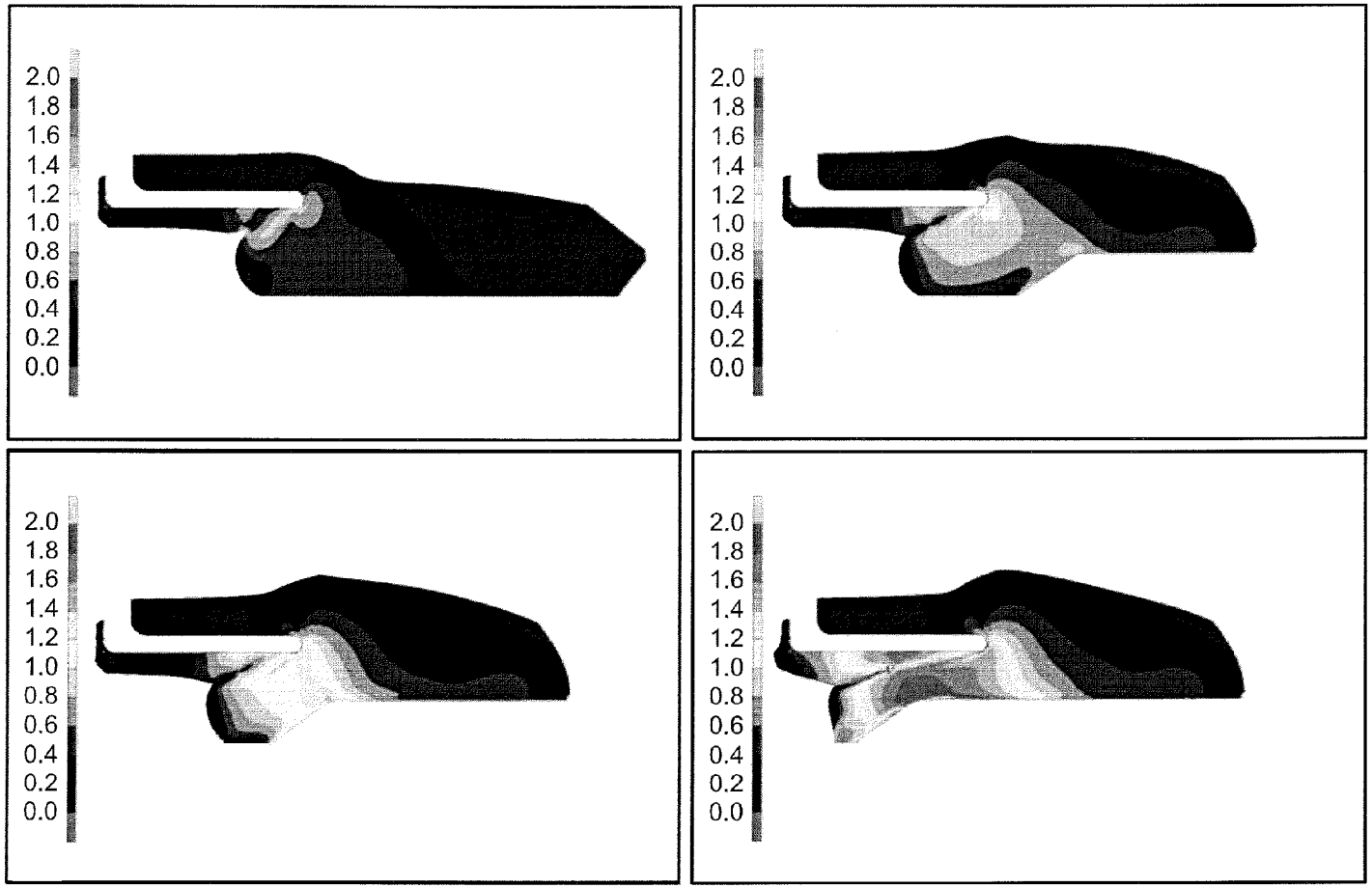
FIG. 5B PRIOR ART
Figure 5C:
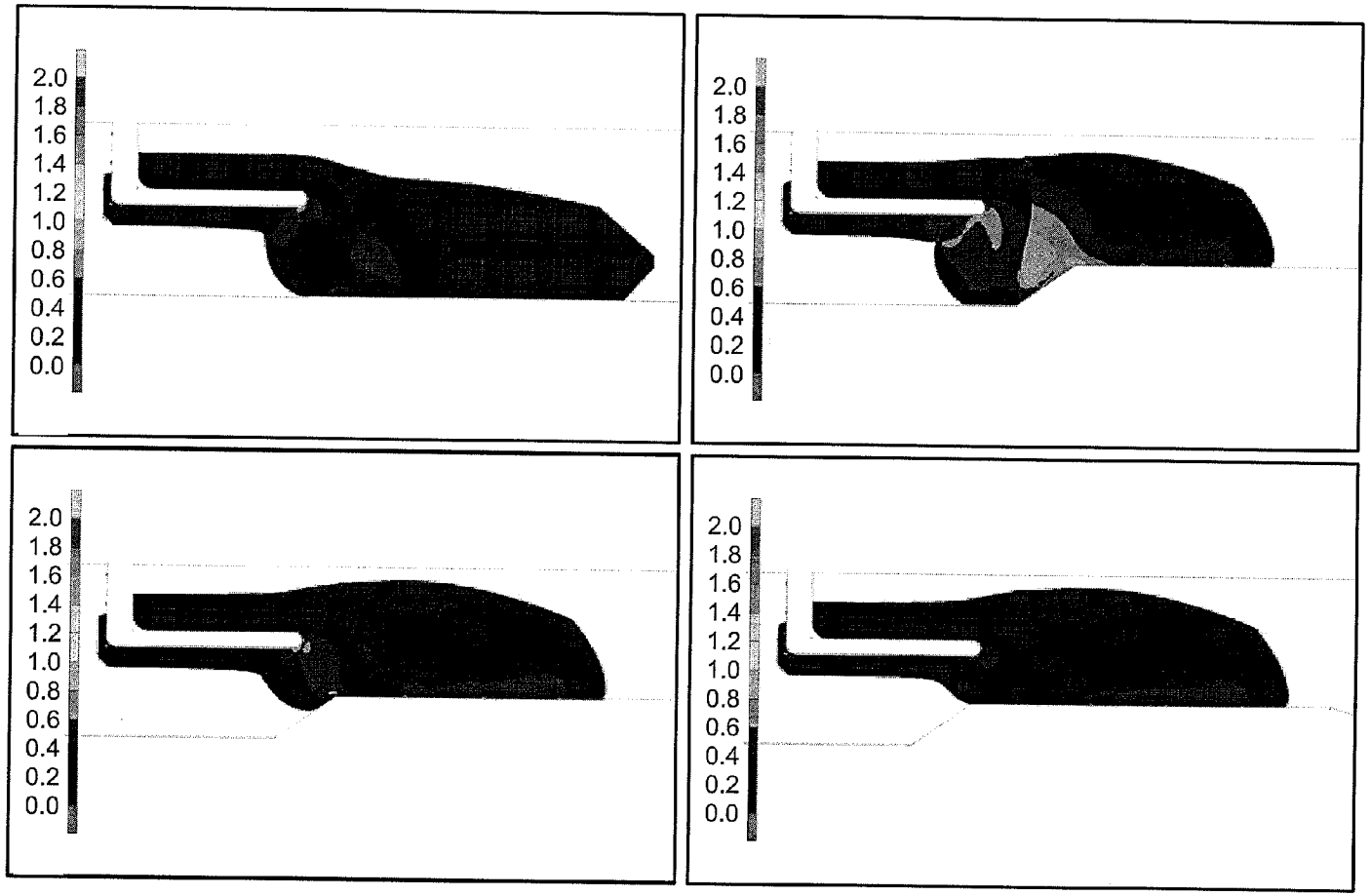

For example, FIGS. 5A-C show finite element analysis ("FEA") models comparing distortion experienced in conventional sealing elements and a sealing element made according to the present disclosure as a drillstring is translated through the drillstring bore. The drillstring replicated in the FEA models of FIGS. 5A-C is made of a series of drill pipes connected together with tool joints, wherein the tool joint outer diameter is larger than the pipe outer diameter. Referring now to FIG. 5A, a FEA model is shown for a conventional single-material sealing element made of HNBR having a hardness of 80 duro (a stiff elastomer) and subject to 825 psi wellbore pressure, as the drillstring passes through the sealing element. FIG. 5B shows a FEA model of a conventional single-material sealing element made of NBR having a hardness of 60 duro (a soft elastomer) and subject to 500 psi dynamic pressure, as a drillstring is translated through the drillstring bore. FIG. 5C shows a FEA simulation of a dual-material sealing element made according to the present disclosure, having a stiff elastomer material and a soft elastomer material, and subject to 500 psi dynamic pressure, as a drillstring is translated through the drillstring bore. As shown in FIGS. 5A-C, the amount of distortion increases as the tool joints pass through the sealing element and while the sealing element is on the tool joints. In particular, distortion is shown to occur in the throat region and attachment end of the sealing element as a tool joint moves through the drillstring bore. The amount of distortion experienced in the prior art sealing element simulations is more severe than the amount of distortion experienced in the simulation for the dual-material sealing element made according to the present disclosure.

Figure 1:
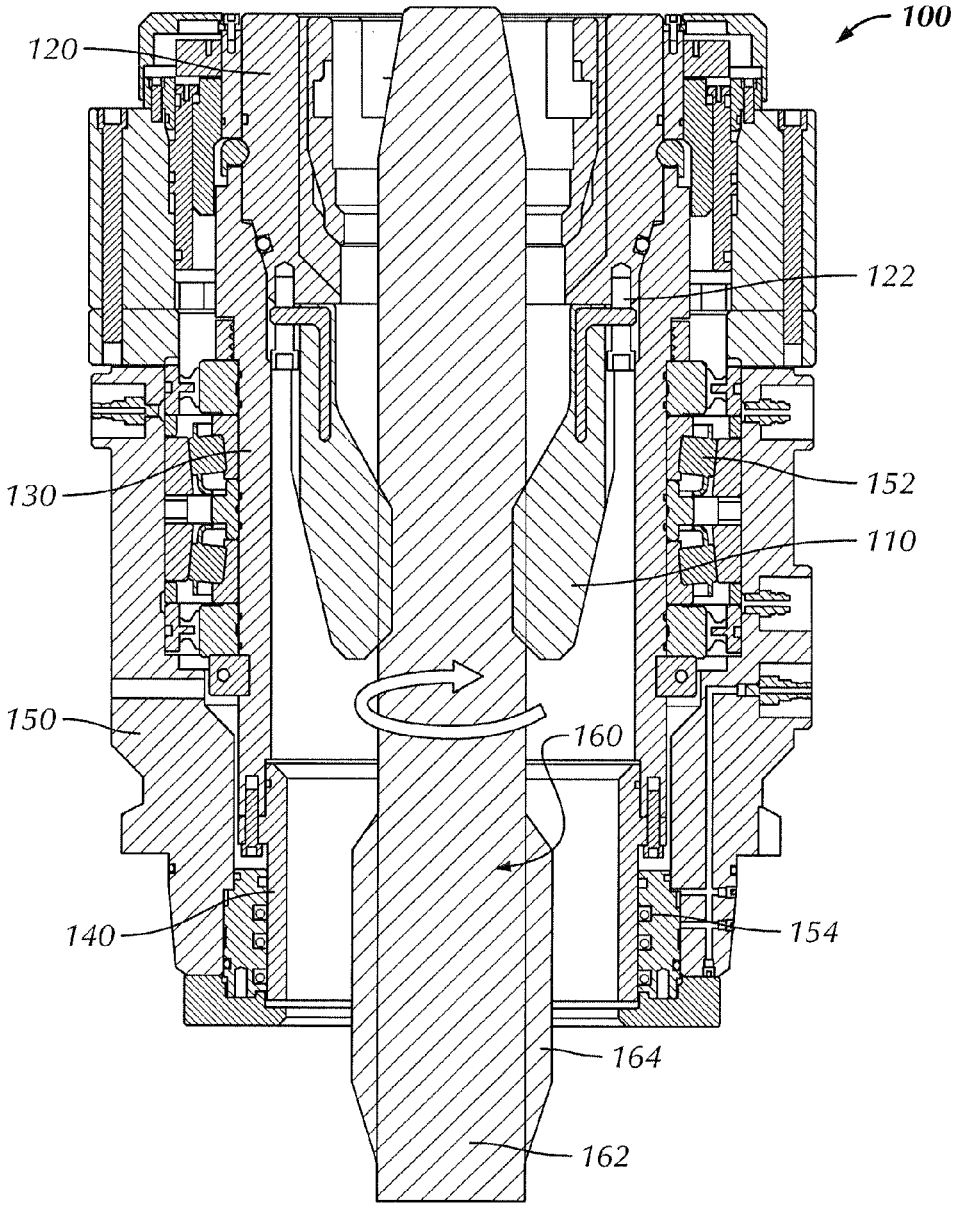
FIG. 1 PRIOR ART
FIG. 1 is a cross-sectional view of a conventional rotating control device.
Figure 2A:
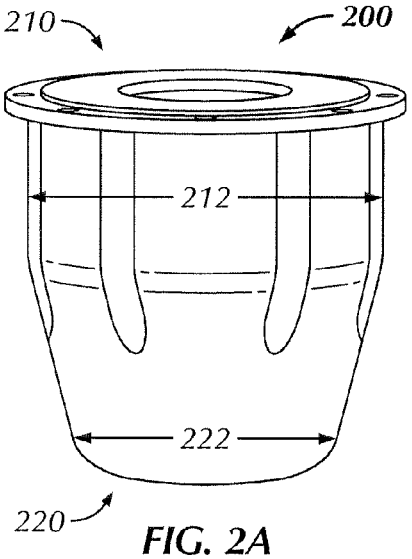
FIG. 2A PRIOR ART
FIGS. 2A-B are pictures of a prior art RCD sealing element.
Figure 2B:
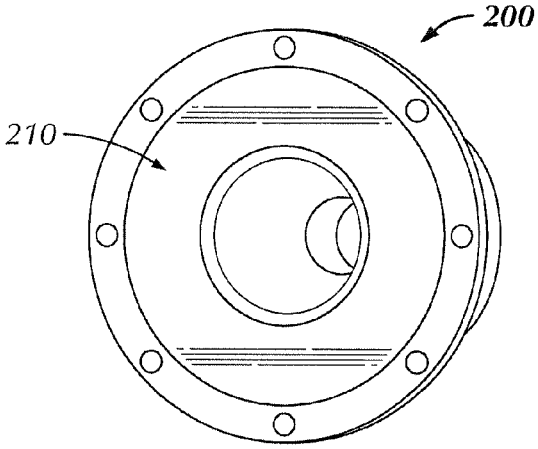
FIG. 2B PRIOR ART
Figure 6:
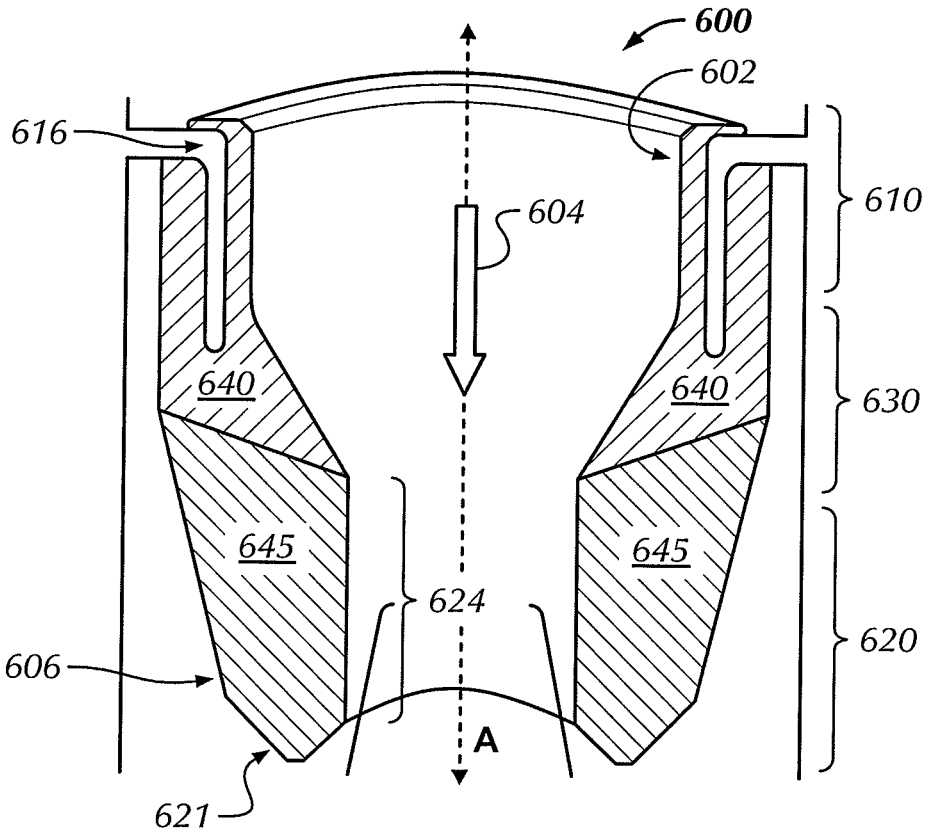
FIG. 6 is a cross-sectional view of a sealing element according to embodiments of the present disclosure.

Referring now to FIG. 6, a cross-section of an exemplary sealing element according to embodiments of the present disclosure is shown. As shown, the inner surface 602 of the sealing element 600 forms a drillstring bore 604, which extends axially through the sealing element 600. The sealing element has an attachment end 610, a nose end 620 opposite from the attachment end 610, and a throat region 630 between the attachment end 610 and the nose end 620. Upon assembly of the sealing element 600 to a RCD (not shown), the attachment end 610 is positioned closest to the top of the wellbore and attaches to the drive-bushing (shown in FIG. 1 as 120) of the RCD via a metal attachment piece (not shown). In particular, a receiving cavity 616 extends into the attachment end 610 substantially parallel with the drillstring bore 604 to receive the metal attachment piece. Alternatively, in other embodiments, a sealing element attachment end may be bonded to the drive-bushing (shown in FIG. 1 as 120). Sealing elements that are directly bonded to the drive-bushing (rather than attached via a metal attachment piece) are commonly referred to as "combo" sealing elements. In the embodiment shown in FIG. 6, the attachment end 610 and a portion of the throat region 630 are made of a stiff elastomer material 640, while the remaining portion of the throat region 630 and the nose end 620 are made of a soft elastomer material 645.

As shown, the sealing element 600 has a longitudinal axis A extending therethrough. The inner surface 602 and outer surface 606 of the attachment end 610 is substantially parallel with the longitudinal axis A. A contacting section 624 of the inner surface 602 of the nose end 620 is also substantially parallel with the longitudinal axis A and configured to contact and seal around a drillstring. The outer surface 606 of the nose end 620 slopes vertically inward from the outer surface 606 of the attachment end 610 toward the longitudinal axis A. A pointed bottom 621 is formed at the bottom of the nose end 620, wherein the inner surface 602 of the bottom 621 of the nose end 620 slopes vertically outward from the contacting section 624 of the nose end 620 and the outer surface 606 of the nose end slopes vertically inward to meet the inner surface 602. The inner surface 602 of the throat region slopes vertically inward from the inner surface 602 of the attachment end 610 to the contacting section 624 of the nose end 620, thus forming a funnel-shaped portion of the drillstring bore 604. As shown, the inner surface of the throat 630 has a larger slope (i.e., it slopes more vertically, along the longitudinal axis, than horizontally) than the inner surface of the nose bottom 621. Thus, the geometry of the inner surface of the sealing element is such that it is easier to pass a tool joint down (from attachment end to nose end) than up (from nose end to attachment end) in embodiments having tool joints with larger diameters than the drill pipe. In such embodiments, passing a tool joint up through the sealing element (from nose bottom to attachment end) is abrupt and exerts high compression and tension stresses on the sealing element, whereas passing a tool joint down (from the attachment end to the nose bottom) has a smoother transition.

The inventors of the present disclosure have found that in both actions of passing a tool joint up and down with applied wellbore pressure, increased amounts of stresses (including compression and tension stresses from expanding and contracting the inner diameter of the nose end of the sealing element) and distortion lead to failure of the sealing element, especially in the throat region of the sealing element. Sealing elements made according to the present disclosure provide increased resistance to such distortion by including at least one stiff elastomer material, which may provide improved resistance to buckling under high stripping pressures, and at least one soft elastomer material, which may provide improved tear resistance when encountering torsional loading, or other harsh dynamic conditions. In particular embodiments, the at least one stiff elastomer material may form at least a portion of the throat region of a sealing element (which often encounters larger amounts of distortion than other regions of a sealing element) to provide increased strength.

Figure 7A:
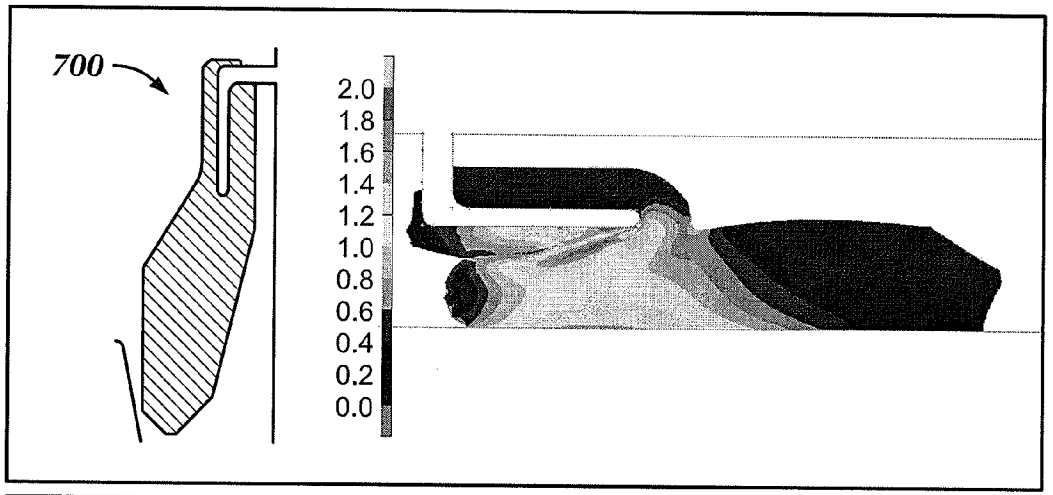
FIGS. 7A-B are FEA plots of a prior art sealing element and a sealing element made according to embodiments of the present disclosure.
Figure 7B:
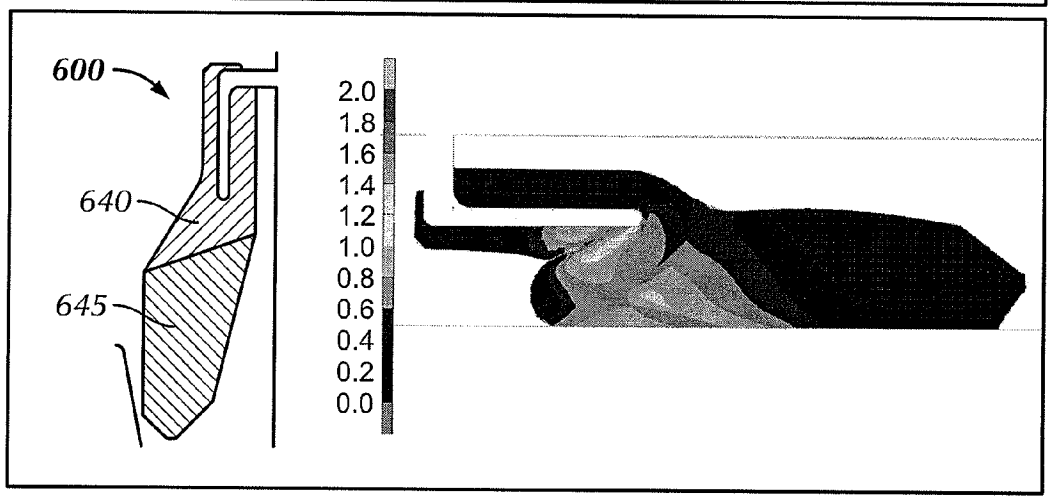

Referring now to FIGS. 7A and 7B, FEA models are shown for sealing elements under 2,500 psi static pressure. In particular, FIG. 7A shows a FEA model generated for a conventional, single-material sealing element 700, while FIG. 7B shows a FEA model for the sealing element 600 shown in FIG. 6, which is made of a stiff elastomer material 640 and a soft elastomer material 645. Similar to the results shown above in FIGS. 5A-C, severe distortion occurs in the throat region and attachment end of the convention sealing element, while substantially less distortion occurs in the sealing element made according to the present disclosure. The distortion area shown in FIGS. 7A and 7B is generally larger than in FIGS. 5A-C due to the increased pressure conditions used for generating the FEA models.

Figure 8:
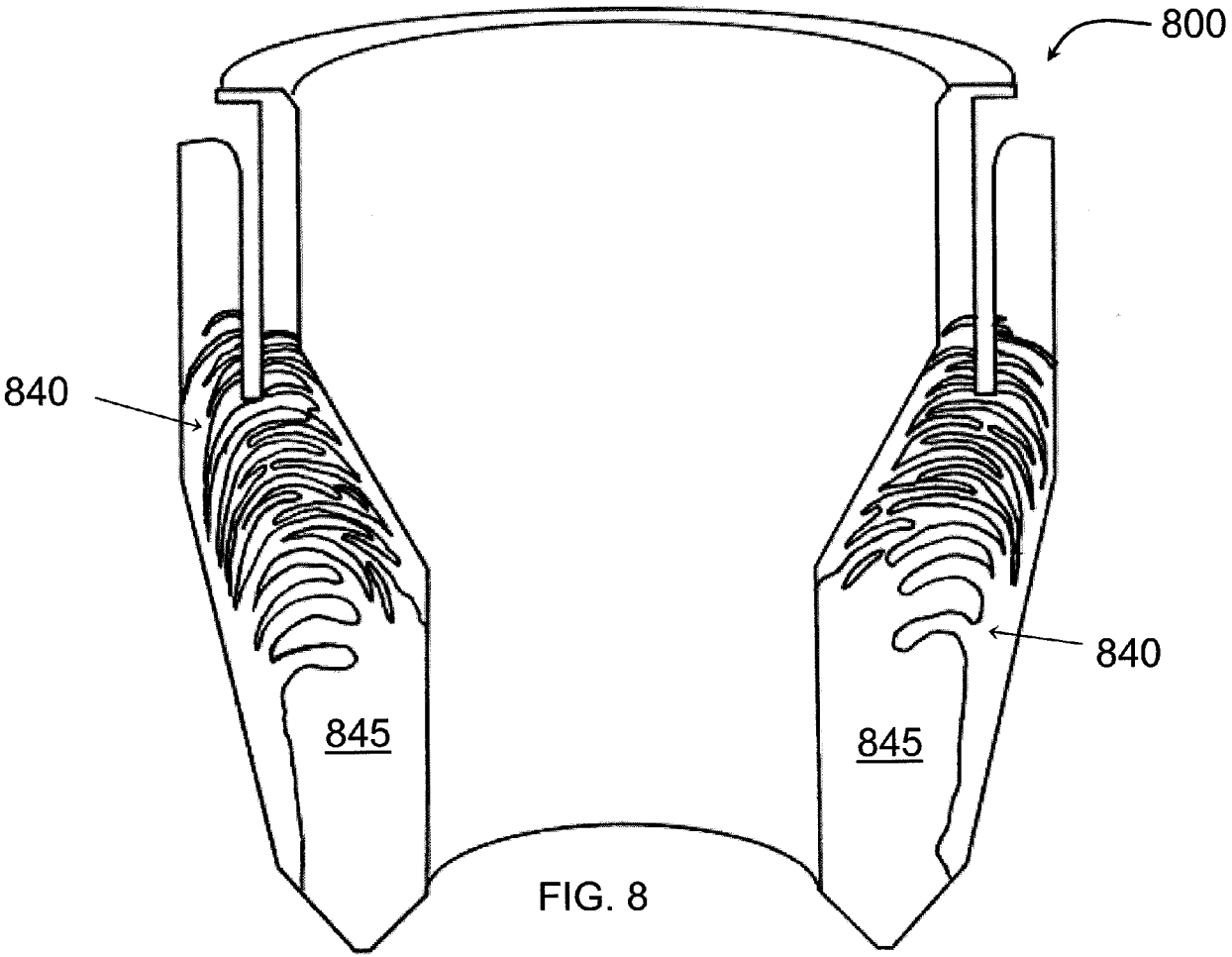
FIG. 8 is a cross-sectional view of a sealing element made in accordance with embodiments of the present disclosure.

Although embodiments of the present disclosure have been described thus far as having at least two separate portions, wherein each separate portion has a different type of elastomer material, it is also within the scope of the present disclosure for the at least two elastomer materials to partially mix. In particular, as shown in FIG. 8, at least two elastomer materials were used to form a sealing element according to embodiments of this disclosure. During the manufacturing process, the at least two elastomer materials partially mixed to form a "marbleized" or "swirl" design such that a plurality of planar and/or non-planar interfaces are formed between the at least two elastomer regions. As shown, stiff elastomer regions 840 extend into soft elastomer regions 845 in the throat region of a sealing element 800. The stiff elastomer regions 840 are each made of the same stiff elastomer material, and the soft elastomer regions 845 are each made of the same soft elastomer material. Thus, although the elastomer regions do not fall under the traditional description of "continuous" or "uninterrupted", each elastomer region is separate from the other elastomer region.

According to embodiments of the present disclosure, sealing elements may have a stiff elastomer region and a soft elastomer region configured in various positions of the sealing element. In particular embodiments, at least a portion of the attachment end of a sealing element is made of a stiff elastomer material and the remaining portions of the sealing element are made of a soft elastomer material.

Figure 9:
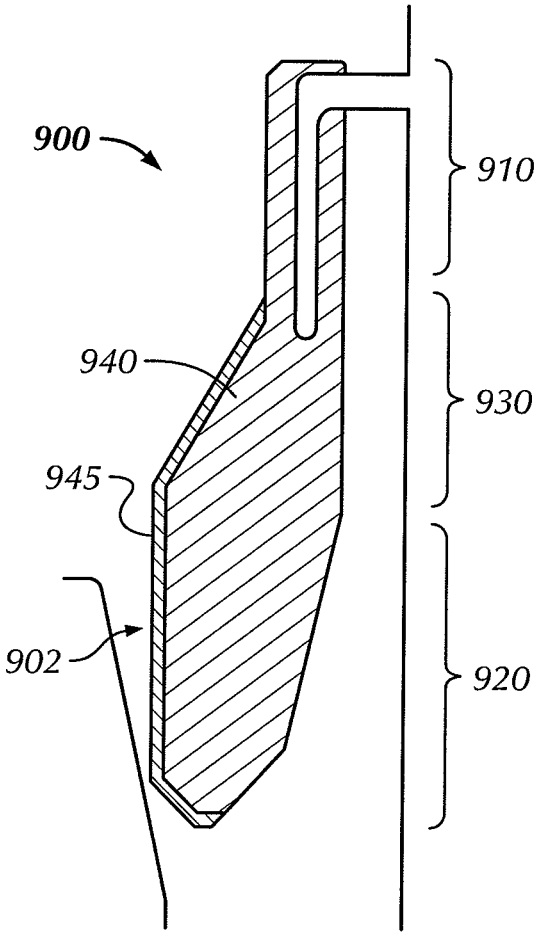
FIG. 9 is a cross-sectional view of a sealing element made according to another embodiment of the present disclosure.

For example, referring to FIG. 9, a sealing element 900 is made of two different elastomer regions, a stiff elastomer region 940 and a soft elastomer region 945. The stiff elastomer region 940 forms the attachment end 910 and at least 95 percent of the nose end 920 and throat region 930 of the sealing element. The soft elastomer region 945 forms the inner surface 902 of the nose end 920 and the throat region 930 of the sealing element 900. As shown, the soft elastomer region 945 has a thickness of about 2 to 10 percent of the total thickness of the nose end 920 or throat region 930. In some embodiments, the soft elastomer region 945 may form a thin inner surface layer along a length of the sealing element having a thickness ranging from about 2 percent of the sealing element thickness to about 20 percent of the sealing element thickness. It should be noted that the thickness of a soft elastomer inner surface layer may vary depending on the design and size of the sealing element. As used herein, the term "thickness" may refer to a radial distance within the sealing element, while the term "length" may refer to an axial distance within the sealing element.

Further, the stiff elastomer region 940 may be a rubber material having a hardness ranging from greater than 70 to about 90 duro, and the soft elastomer region 945 may be a rubber material having a hardness ranging from about 50 to 70 duro. In the exemplary embodiment shown in FIG. 9, the sealing element 900 may have a stiff elastomer region 940 made of HNBR having a hardness of about 75 to 85 duro, and a soft elastomer region 945 made of HNBR having a hardness of about 55 to 65 duro.

Figure 10A:
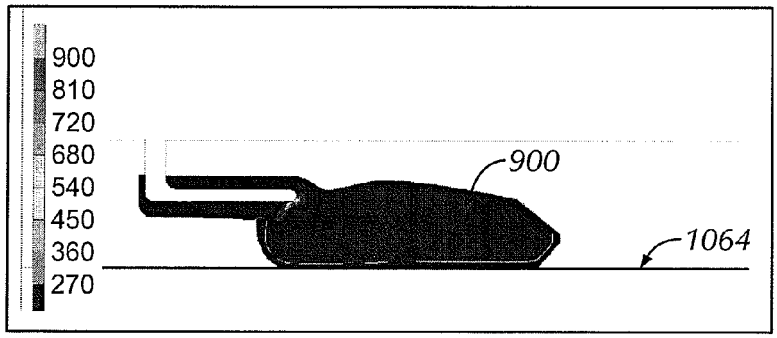
FIGS. 10A-D are FEA models of a sealing element made according to the embodiment shown in FIG. 9.
Figure 10B:
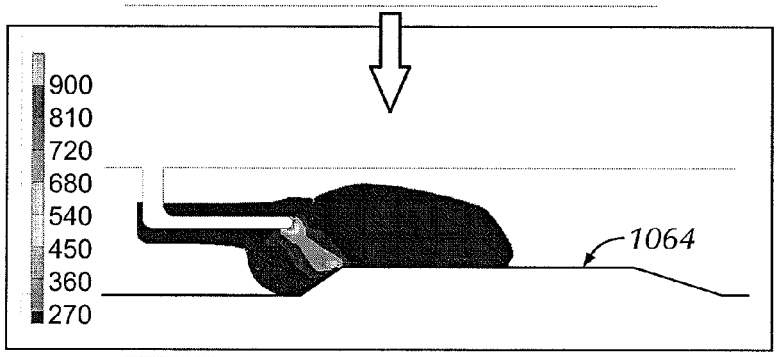
Figure 10C:
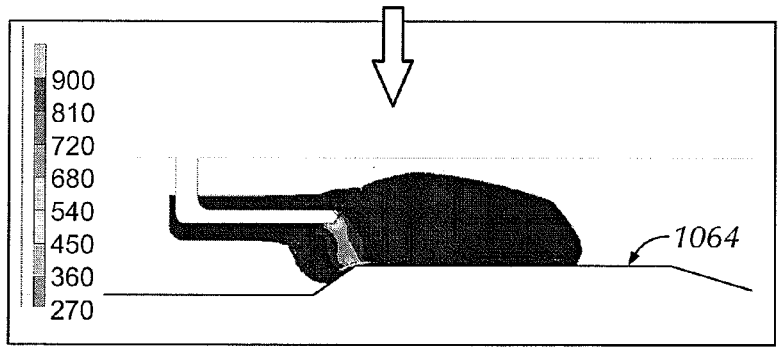
Figure 10D:
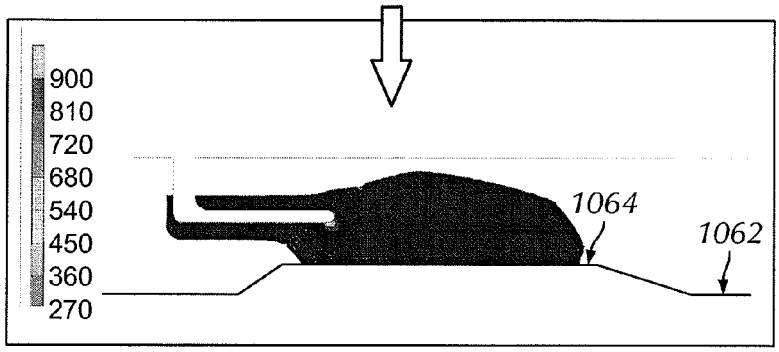

By placing the soft elastomer region 945 along the inner surface 902 of the nose end 920 and the throat region 930 of the sealing element 900, the inventors of the present disclosure have found that the sealing element 900 may experience less distortion during stripping than conventional, single-material sealing element. Referring now to FIG. 10A-D, FEA models were generated using a sealing element made in accordance with the sealing element shown in FIG. 9 and described above, wherein the sealing element 900 was subjected to stripping conditions under 750 psi. As shown, exemplary steps of traversing a drill string through the sealing element 900 are represented in each of FIGS. 10A-D. In particular, FIG. 10A shows the amount of distortion in the sealing element 900 as a drill pipe 1062 portion of the drill string passes through the bore hole of the sealing element. FIG. 10B shows the amount of distortion in the sealing element 900 as a tool joint 1064 portion of the drill string passes through the nose end and throat region of the sealing element. FIG. 10C shows the amount of distortion in the sealing element 900 as the tool joint 1064 portion of the drill string passes farther through the throat region of the sealing element. FIG. 10D shows the amount of distortion in the sealing element while the sealing element is on the tool joint 1064, i.e., the tool joint portion of the drill string contacts the entire nose end and throat region of the sealing element.

As shown, the sealing element experiences less distortion during the steps of FIGS. 10A and 10D, where the sealing element is entirely on the drill pipe or entirely on the tool joint portion of the drill string. During the steps shown in FIGS. 10B and 10C, wherein the sealing element is partially on the drill pipe and partially on the tool joint, increased distortion occurs in the throat region, proximate to the attachment end. Advantageously, by using a stiff elastomer material in the area affected most by distortion, increased structural stability is provided to hold dynamic pressure. By using a soft elastomer material along at least a portion of the inner surface of the sealing element, increased resistance to dynamic impact, torsional loading, wear, and tear is provided.

Referring now to FIGS. 11A-E, exemplary embodiments of the present disclosure are shown, wherein sealing elements 1100 have a stiff elastomer region 1140 and a soft elastomer region 1145 configured in various positions of the sealing element. In particular, at least a portion of the attachment end of a sealing element is made of a stiff elastomer material and the remaining portions of the sealing element are made of a soft elastomer material.

Figure 11A:
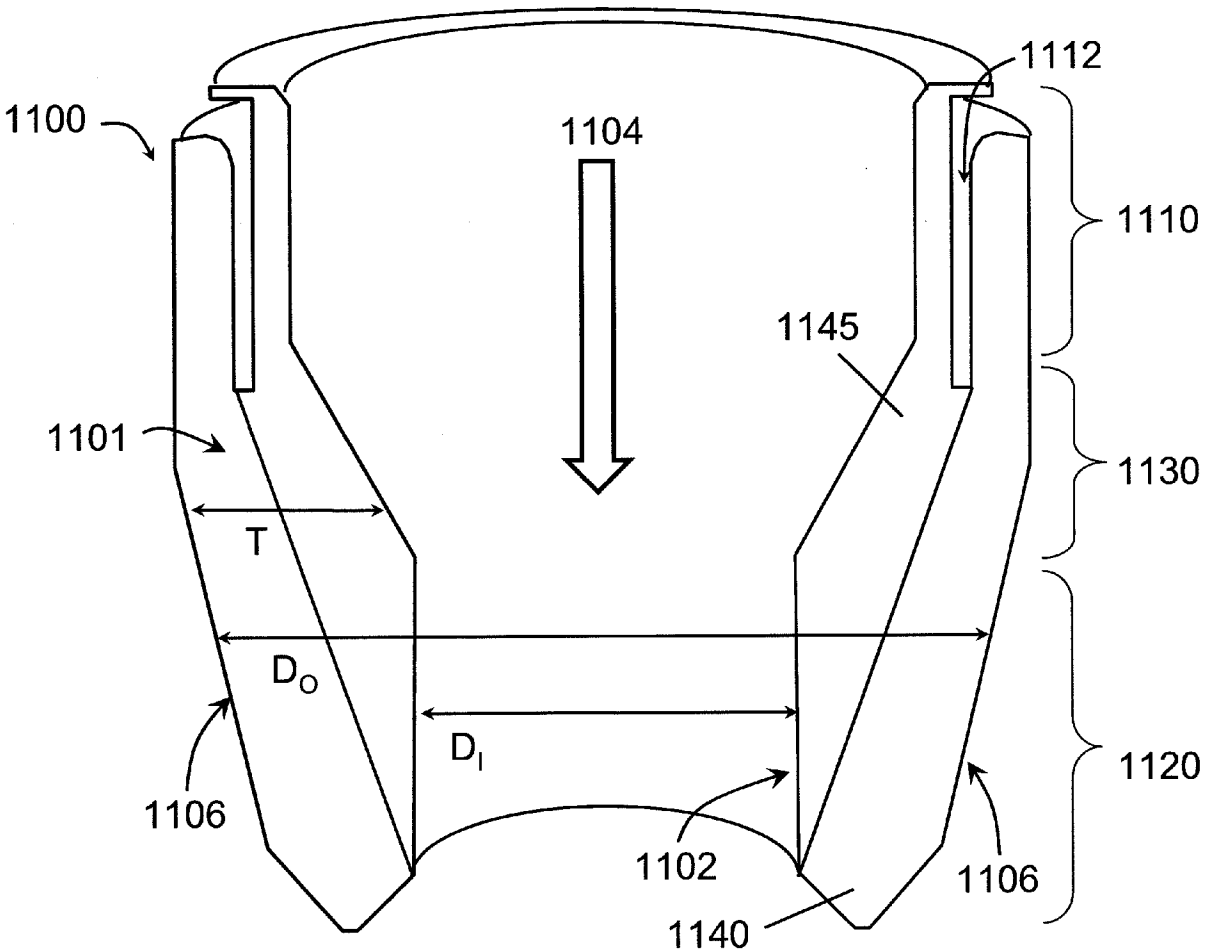
FIGS. 11A-E are cross-sectional views of sealing elements made according to various embodiments of the present disclosure.

As shown in FIGS. 11A-E, cross-section views of sealing elements 1100 according to various embodiments of the present disclosure are shown. In particular, the shape of the sealing elements 1100 is described in reference to the shape of a cross-sectional view of the sealing element wall 1101, as shown in FIG. 11A. The sealing element wall 1101 has a thickness T that varies along the length of the wall 1101. The shape of the sealing element may also be described in reference to an attachment end 1110, a nose end 1120, and a throat region 1130 between the attachment end 1110 and nose end 1120. Each sealing element 1100 has an inner surface 1102 extending along the nose end 1120, the throat region 1130, and the attachment end 1110, which forms a drillstring bore 1104 extending axially therethrough. The sealing element 1100 has an inner diameter $D_I$ extending between the inner surface 1102 of the sealing element 1100 and an outer diameter $D_O$ extending between the outer surfaces 1106 of the sealing element 1100.

The inner surface 1102 of the attachment end 1110 and nose end 1120 runs substantially parallel with the drillstring bore 1104. The inner surface of the attachment end 1110 is a radial distance from the inner surface of the nose end 1120 such that the inner diameter $D_I$ of the sealing element is smaller at the nose end 1120 than at the attachment end 1110. The inner surface 1102 of the throat sealing element 1100 slopes vertically to connect the inner surface 1102 of the attachment end and the inner surface of the nose end 1120. The outer surface 1106 of the attachment end 1110 is substantially parallel with the drill string bore 1104, and the outer surface 1106 of the nose end vertically slopes inward toward the inner surface 1102 of the nose end, thus giving the sealing element 1500 a cone-like shape. The attachment end 1110 has a receiving cavity 1112 extending into the attachment end substantially parallel with the drill string bore 1104. The receiving cavity 1112 may extend partially into the attachment end 1110, or the receiving cavity 1112 may extend the entire length of the attachment end 1110.

The shapes of the sealing elements 1100 shown in FIGS. 11A-E are exemplary of sealing element shapes. One skilled in the art may appreciate that similar shapes may be used for RCD sealing elements without departing from the scope of this disclosure. In other words, the shape of the inner and outer surfaces of a sealing element wall may vary and still have two or more elastomer regions therein.

Various configurations of the two or more elastomer regions according to embodiments of the present disclosure are shown in FIGS. 11A-E. In particular, as shown in FIG. 11A, the soft elastomer region 1145 forms the inner surface of the sealing element 1100 and has a thickness ranging from about 30 percent of the sealing element thickness T to about 60 percent of the sealing element thickness T from the inner surface, along the length of the sealing element. Because the thickness T of the sealing element varies along its length, the thickness of the soft elastomer region 1145 may also vary with respect to the total thickness T of the sealing element wall 1101. A stiff elastomer region 1140 forms the outer surface 1106 of the sealing element 1100 and the remaining thickness of the sealing element.

Figure 11C:
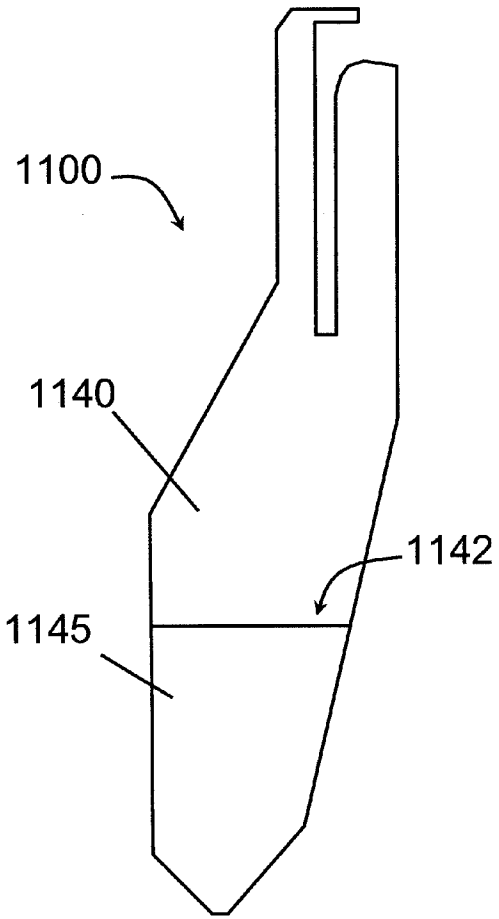
Figure 11B:
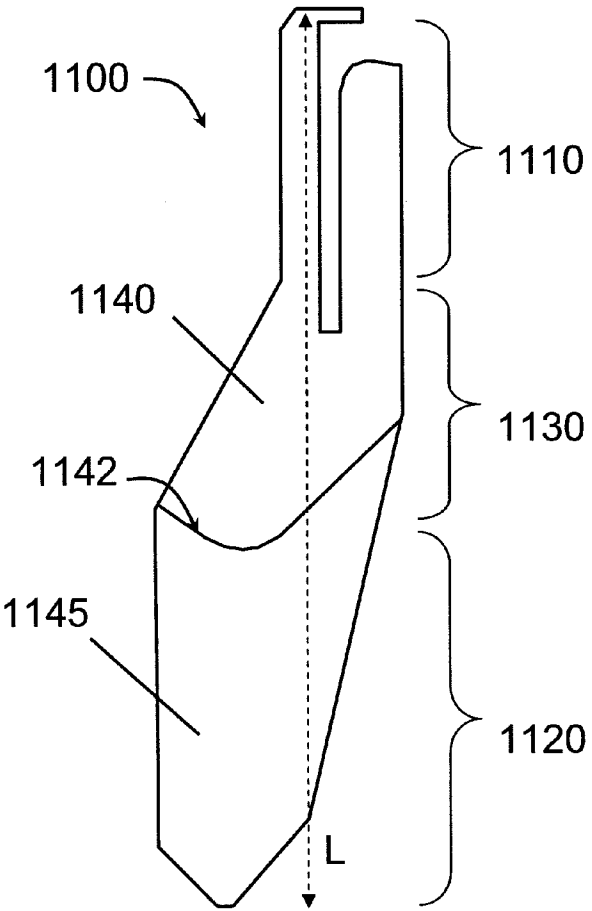

As shown in FIGS. 11B and 11C, the stiff elastomer region 1140 may form the entire attachment end 1110 (i.e., extend the entire thickness of the attachment end) and at least a portion of the throat region 1130, while the soft elastomer region 1145 may form the remaining portion of the sealing element 1100. For example, the stiff elastomer region 1140 may extend from about 30 percent to about 80 percent of length L of the sealing element 1100, wherein the length L refers to the length of the sealing element 1100 measured from the top of the attachment end 1110 to the bottom of the nose end 1120. Further, the interface 1142 between the stiff elastomer region 1140 and the soft elastomer region 1145 may be non-planar, as shown in FIG. 11B, or the interface 1142 may be planar, as shown in FIG. 11C.

Figure 11E:
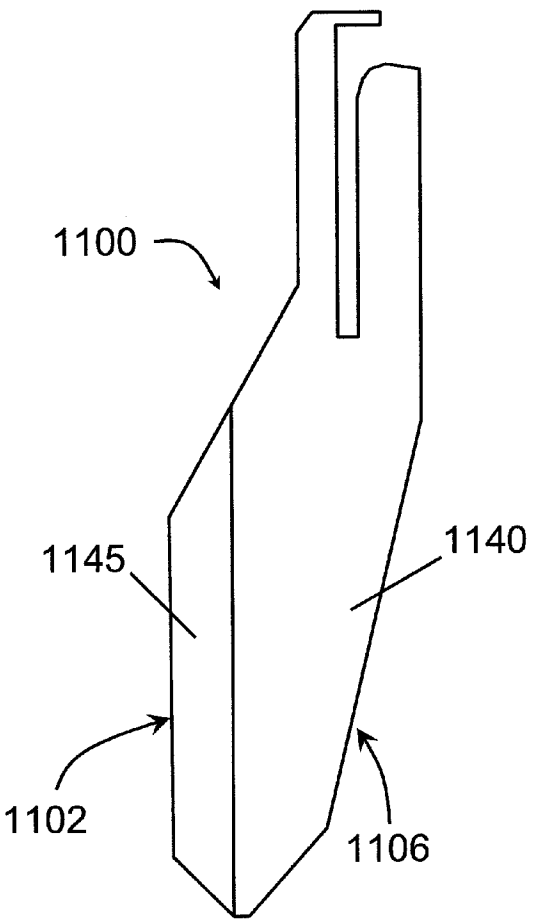
Figure 11D:
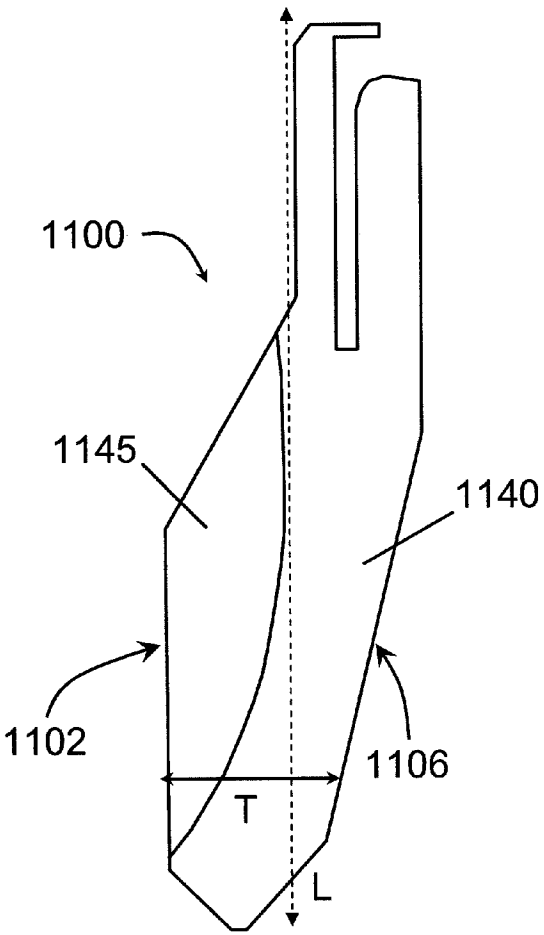

As shown in FIGS. 11D and 11E, the soft elastomer region 1145 may extend along a portion of the length L of the sealing element and extend from a surface 1102, 1106 of the sealing element into the sealing element 1100, while the stiff elastomer region 1140 forms the remaining part of the sealing element 1100. Referring to FIG. 11D, the soft elastomer region 1145 extends along the inner surface 1102 of the throat region 1130 and along a majority of the inner surface 1102 of the nose end 1120. The soft elastomer region 1145 also extends into the sealing element 1100 from the inner surface 1102 such that it has a thickness ranging from about 5 percent to about 60 percent of the thickness T of the sealing element. In particular, as shown in FIG. 11D, the interface 1142 between the soft elastomer region 1145 and the stiff elastomer region 1140 is non-planar. As such, the thickness of the soft elastomer region 1145 varies along the length L of the sealing element 1100. Alternatively, the interface 1142 may be planar. Referring now to FIG. 11E, the soft elastomer region 1145 extends along the entire inner surface 1102 of the nose end 1120 and along a portion of the inner surface of the throat region 1130. The interface 1142 between the soft elastomer region 1145 and the stiff elastomer region 1140 is planar and is substantially parallel with the drill string bore 1104. Because the thickness T of the sealing element varies along its length L, the thickness of the soft elastomer region 1145 also varies with respect to the total thickness T of the sealing element. In some embodiments, the thickness of the soft elastomer region 1145 may vary between 5 percent and 100 percent of the thickness of the sealing element. Selection of the thickness may depend on how much length coverage is selected (e.g., entire throat coverage or partial throat coverage). Further, the thickness and length of the soft elastomer region may be selected based on the total volume of the sealing element. For example, the soft elastomer region of a sealing element may comprise from about 5 percent to about 60 percent of the total volume of the sealing element.

According to other embodiments of the present disclosure, a sealing element may include more than two types of materials. For example, in some embodiments, a sealing element may be made of two or more different types of stiff elastomer materials and one soft elastomer material. In other embodiments, a sealing element may have two or more different types of soft elastomer materials and one stiff elastomer material. In embodiments having more than two types of elastomer materials, the elastomer materials may be arranged within a sealing element in order of increasing stiffness through the length of the sealing element, wherein the elastomer material having the highest stiffness is in the attachment end and optionally in a portion of the throat region, the elastomer material having the highest softness is in the nose end of the sealing element, and elastomer materials having stiffness or softness values lower than the stiffest elastomer material and higher than the softest elastomer material are in between the stiffest and softest materials. Alternatively, in embodiments having more than two types of elastomer materials, the materials may be arranged within a sealing element in order of increasing stiffness through the thickness of the sealing element, wherein the elastomer having the highest softness forms the inner surface of the nose end and the elastomer material having the highest stiffness forms the outer surface of the sealing element.

Figure 12:
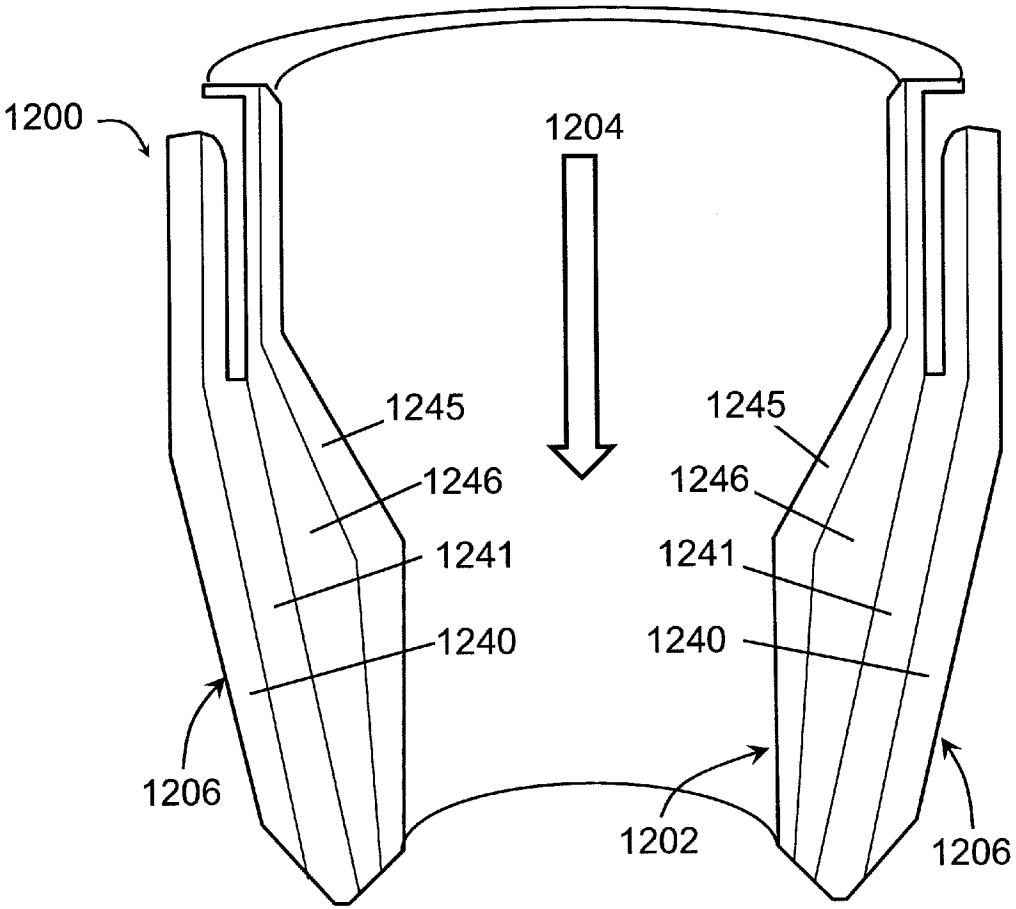
FIG. 12 is a cross-sectional view of a sealing element made according to another embodiment of the present disclosure.

For example, as shown in FIG. 12, a sealing element 1200 according to embodiments of the present disclosure may have more than two types of elastomer materials. In particular, FIG. 12 shows a sealing element 1200 made of two or more elastomer materials that vary radially from the inner surface 1202 of the sealing element to the outer surface 1206 of the sealing element to form two or more elastomer regions 1240, 1245, 1241, 1246 parallel to the drillstring bore 1204. Each of the elastomer regions 1240, 1245, 1241, 1246 is made of a different elastomer material, wherein at least one elastomer material is a soft elastomer material having a hardness of 70 duro or less, and at least one elastomer material is a stiff elastomer material having a hardness greater than 70 duro. For example, the sealing element 1200 of FIG. 12 may include two stiff elastomer regions 1240, 1241, wherein each stiff elastomer region is made of a stiff elastomer material having a hardness of greater than 70 duro, and two soft elastomer regions 1245, 1246, wherein each soft elastomer region is made of a soft elastomer material having a hardness of 70 duro or less. Further, the elastomer material of each region 1240, 1241, 1245, and 1246 may vary radially and parallel to the drillstring bore 1204 such that the hardness of each region gradually increases from the inner surface 1202 to the outer surface 1206. In other embodiments, a sealing element may have one soft elastomer region and two or more stiff elastomer regions varying radially and parallel to the drillstring bore. Alternatively, a sealing element may have one stiff elastomer region and two or more soft elastomer regions varying radially and parallel to the drillstring bore. Further, although FIG. 12 shows a sealing element having four different elastomer regions parallel to the drillstring bore, other embodiments may include more or less than four different elastomer regions parallel or substantially parallel to the drillstring bore and varying concentrically from the inner surface to the outer surface of the sealing element.

Figure 13:
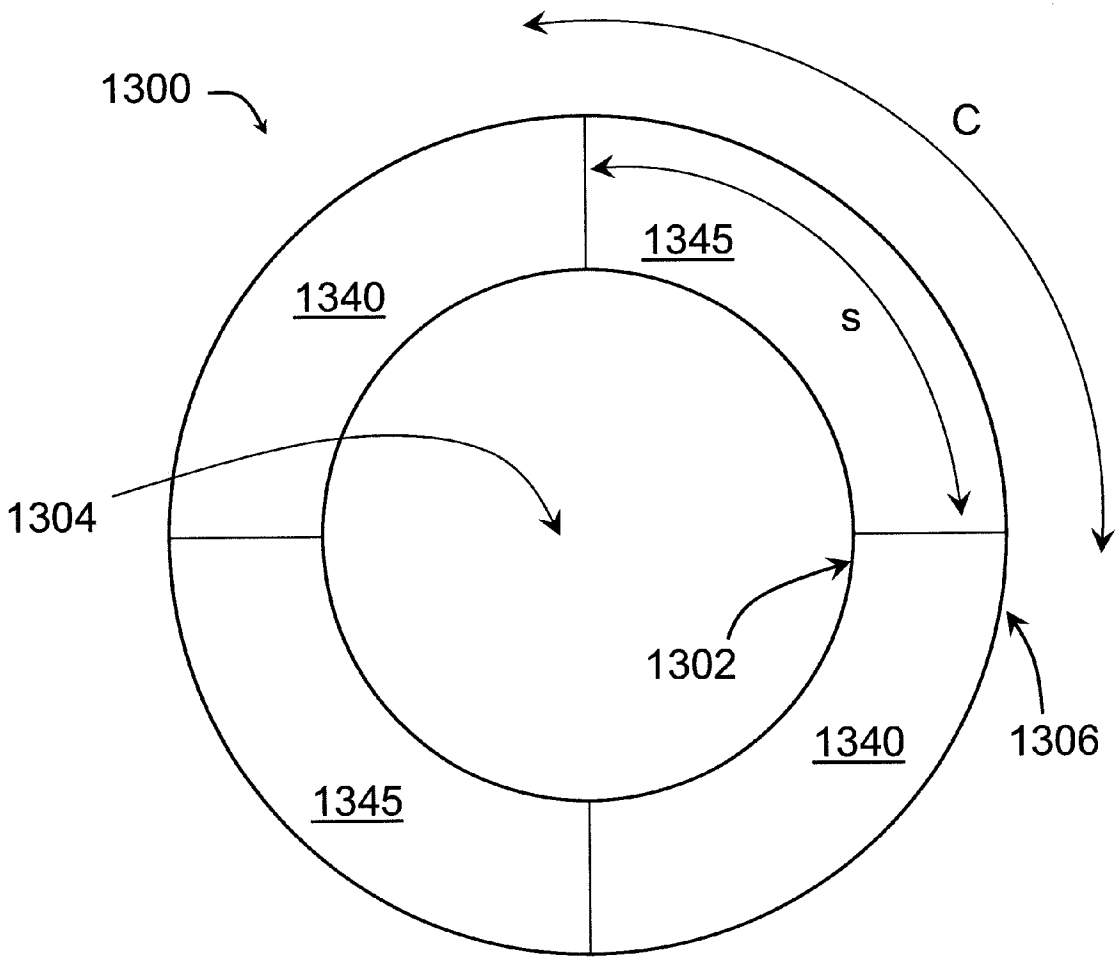
FIG. 13 is a cross-sectional view of a sealing element made according to another embodiment of the present disclosure.

According to other embodiments of the present disclosure, a sealing element may have at least one soft elastomer region and at least one stiff elastomer region vary around the circumference of the sealing element, wherein each soft elastomer region is made of a soft elastomer material having a hardness of 70 duro or less and each stiff elastomer region is made of a stiff elastomer material having a hardness greater than 70 duro. For example, as shown in FIG. 13, a cross-sectional view of a sealing element 1300 with varying elastomer regions 1340, 1345 around the circumference C of the sealing element 1300 is shown. In particular, the cross-section of the sealing element 1300 is taken along a plane perpendicular to the drillstring bore 1304, rather than parallel with the drillstring bore, or along the length of the sealing element, as shown in cross-sectional views of FIGS. 11A and 12, for example. The sealing element 1300 shown in FIG. 13 has two stiff elastomer regions 1340 and two soft elastomer regions 1345, wherein each region forms a segment, or portion, or the circumference of the sealing element. Each elastomer region 1340, 1345 extends a distance around the circumference C of the sealing element and from the inner surface 1302 of the sealing element to the outer surface 1306 of the sealing element. Each elastomer region may also extend a length of the sealing element, such as the entire length of the sealing element (i.e., from the nose end to the attachment end of the sealing element).

As shown in FIG. 13, each segment, i.e., region of soft and stiff elastomer material 1340, 1345, forms $\frac{1}{4}^{th}$ of the sealing element, as measured around the circumference C of the sealing element. The measurement of a distance around the circumference may also be referred to as an arc length s measurement. Thus, the arc length s of each elastomer region 1340, 1345 shown in FIG. 13 is equal to $\frac{1}{4}^{th}$ of the circumference C of the sealing element. However, in other embodiments, different amounts of soft and stiff elastomer regions may form a sealing element, and soft and stiff elastomer regions may form different proportions of the circumference of the sealing element. For example, a sealing element may have one stiff elastomer region and one or more soft elastomer regions, or one soft elastomer region and one or more stiff elastomer regions. Further, an elastomer region may extend an arc length greater than or less than $1/4^{th}$ of the circumference of the sealing element. For example, elastomer regions may form $1/8^{th}$, $1/16^{th}$, or other arc length measurements of the sealing element.

In yet other embodiments having more than two types of elastomer materials, the elastomer materials may be arranged to correspond with the amount of distortion a sealing element is subjected to during stripping. For example, an elastomer material having the highest stiffness may be positioned in the area of a sealing element that is subject to the largest amount of distortion (such as the throat region), and elastomer materials having lower stiffness and the highest softness may be positioned in areas of the sealing element that is subject to less amounts of distortion.

Advantageously, in embodiments having a stiff elastomer region in the attachment end and throat region of the sealing element, which are most susceptible to distortion, the stiff elastomer material provides increased resistance to buckling. Further, although the stiff elastomer material tends to split when encountering misalignment, hard-banding, or other harsh dynamic conditions, a soft elastomer region may be positioned along at least a portion of the inner surface of the nose end and throat region to make the regions more adaptable for large deformation and more conformable to contour changes of various tool joints, thus giving the multi-material sealing element improved tear resistance.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A sealing element for a rotating control device, comprising:

an inner surface which forms a drillstring bore extending axially through the sealing element;

an attachment end having a receiving cavity extending into the attachment end substantially parallel with the drillstring bore;

a nose end opposite from the attachment end, wherein the nose end has an inner diameter smaller than the inner diameter of the attachment end;

a throat region between the attachment end and the nose end;

at least one soft elastomer region comprising a soft elastomer material having a hardness of 70 duro or less; and at least one stiff elastomer region comprising a stiff elastomer material having a hardness greater than 70 duro.

2. The sealing element of claim 1, wherein the stiff elastomer region forms the attachment end and at least a portion of the throat region.

3. The sealing element of claim 1, wherein the at least one soft elastomer region forms at least a portion of the inner surface.

4. The sealing element of claim 3, wherein the at least one soft elastomer region forms the inner surface of the nose end.

5. The sealing element of claim 3, wherein the at least one soft elastomer region forms the entire inner surface.

6. The sealing element of claim 1, wherein the at least one soft elastomer region forms the inner surface of the sealing element and has a thickness ranging between 2 percent to about 60 percent of a total thickness of the sealing element.

7. The sealing element of claim 1, wherein the at least one stiff elastomer material and the at least one soft elastomer material comprise the same elastomer type.

8. The sealing element of claim 1, wherein the at least one stiff elastomer material and the at least one soft elastomer material comprise a different elastomer type.

9. The sealing element of claim 1, wherein the at least one stiff elastomer material and the at least one soft elastomer material comprise an elastomer type selected from hydrogenated nitrile butadiene rubber, nitrile butadiene rubber, natural rubber, butyl, and urethane.

10. The sealing element of claim 1, wherein an interface between the at least one soft elastomer and the at least one stiff elastomer is planar.

11. The sealing element of claim 1, wherein an interface between the at least one soft elastomer and the at least one stiff elastomer is non-planar.

12. The sealing element of claim 1, wherein a plurality of planar and/or non-planar interfaces are formed between the at least one soft elastomer region and at least one stiff elastomer region.

13. The sealing element of claim 1, wherein a length of the sealing element extends from the top of the attachment end to the bottom of the nose end and wherein the at least one stiff elastomer region forms about 30 percent to about 80 percent of the length of the sealing element from the top of the attachment end.

14. The sealing element of claim 1, wherein the at least one soft elastomer material has a hardness ranging from about 50 to 70 duro.

15. The sealing element of claim 1, wherein the at least one stiff elastomer material has a hardness ranging from greater than 70 to 90 duro.

16. The sealing element of claim 1, further comprising a drive-bushing bonded to the attachment end.

17. The sealing element of claim 1, wherein the two or more elastomer materials vary radially from the inner surface to an outer surface of the sealing element to form two or more elastomer regions parallel to the drillstring bore.

18. The sealing element of claim 17, wherein four different elastomer materials form four elastomer regions parallel to the drillstring bore.

19. The sealing element of claim 1, wherein each elastomer region extends a distance around the circumference of the sealing element and from the inner surface to an outer surface of the sealing element.

20. A rotating control device, comprising:

a sealing element having a drillstring bore extending axially therethrough, wherein the sealing element comprises:

an inner surface which forms the drillstring bore;

an attachment end having a receiving cavity extending into the attachment end substantially parallel with the drill string bore;

a nose end opposite from the attachment end, wherein the nose end has an inner diameter smaller than the inner diameter of the attachment end;

a throat region between the attachment end and the nose end;

at least one soft elastomer region comprising a soft elastomer material having a hardness ranging from about 50 to 70 duro; and at least one stiff elastomer region comprising a stiff elastomer material having a hardness ranging from greater than 70 to about 90 duro; and a metal attachment piece disposed within the receiving cavity of the attachment end;

wherein at least a portion of the attachment end comprises the stiff elastomer material.

21. The rotating control device of claim 20, further comprising a drive bushing, wherein the metal attachment piece is bolted to the drive bushing.

22. The rotating control device of claim 20, wherein the stiff elastomer region forms the attachment end and at least a portion of the throat region.

23. The rotating control device of claim 20, wherein the at least one soft elastomer region forms at least a portion of the inner surface.

24. The rotating control device of claim 23, wherein the at least one soft elastomer region forms the inner surface of the nose end.

25. The rotating control device of claim 23, wherein the at least one soft elastomer region forms the entire inner surface.

26. The rotating control device of claim 20, wherein the at least one soft elastomer region forms the inner surface of the sealing element and has a thickness ranging between 2 percent to about 60 percent of a total thickness of the sealing element.

27. The rotating control device of claim 20, wherein the at least one stiff elastomer material and the at least one soft elastomer material comprise the same elastomer type.

28. The rotating control device of claim 20, wherein the at least one stiff elastomer material and the at least one soft elastomer material comprise a different elastomer type.

29. The rotating control device of claim 20, wherein the at least one stiff elastomer material and the at least one soft elastomer material comprise an elastomer type selected from hydrogenated nitrile butadiene rubber, nitrile butadiene rubber, natural rubber, butyl, and urethane.

30. The rotating control device of claim 20, wherein an interface between the at least one soft elastomer and the at least one stiff elastomer is planar.

31. The rotating control device of claim 20, wherein an interface between the at least one soft elastomer and the at least one stiff elastomer is non-planar.

32. The rotating control device of claim 20, wherein a plurality of planar and/or non-planar interfaces are formed between the at least one soft elastomer region and at least one stiff elastomer region.

33. The rotating control device of claim 20, wherein a length of the sealing element extends from the top of the attachment end to the bottom of the nose end and wherein the at least one stiff elastomer region forms about 30 percent to about 80 percent of the length of the sealing element from the top of the attachment end.

34. The sealing element of claim 20, wherein the two or more elastomer materials vary radially from the inner surface to an outer surface of the sealing element to form two or more elastomer regions parallel to the drillstring bore.

35. The sealing element of claim 34, wherein four different elastomer materials form four elastomer regions parallel to the drillstring bore.

36. The sealing element of claim 20, wherein each elastomer region extends a distance around the circumference of the sealing element and from the inner surface to an outer surface of the sealing element.

* * * * *